US009223253B2

(12) United States Patent
Lior et al.

(10) Patent No.: US 9,223,253 B2
(45) Date of Patent: Dec. 29, 2015

(54) ELECTROSTATIC PRINTING

(75) Inventors: Shai Lior, Nes Ziona (IL); Mark Sandler, Nes Ziona (IL); Peter Nedelin, Nes Ziona (IL)

(73) Assignee: Hewlett-Packard Indigo B.V., Maastricht (NL)

( * ) Notice: Subject to any disclaimer, the term of this patent is extended or adjusted under 35 U.S.C. 154(b) by 0 days.

(21) Appl. No.: 14/373,269

(22) PCT Filed: Jan. 20, 2012

(86) PCT No.: PCT/EP2012/050883

§ 371 (c)(1),
(2), (4) Date: Jul. 18, 2014

(87) PCT Pub. No.: WO2013/107523

PCT Pub. Date: Jul. 25, 2013

(65) Prior Publication Data

US 2015/0055984 A1 Feb. 26, 2015

(51) Int. Cl.

| | |
|---|---|
| ***G03G 15/10*** | (2006.01) |
| ***G03G 15/11*** | (2006.01) |
| ***G03G 9/13*** | (2006.01) |
| ***G03G 9/135*** | (2006.01) |

(52) U.S. Cl.

CPC ..... *G03G 15/11* (2013.01); *G03G 9/13* (2013.01); *G03G 9/131* (2013.01); *G03G 9/132* (2013.01); *G03G 9/135* (2013.01); *G03G 9/1355* (2013.01); *G03G 15/104* (2013.01); *Y10T 428/31855* (2015.04); *Y10T 428/31935* (2015.04)

(58) Field of Classification Search

CPC ..... G03G 9/0825; G03G 9/08755; G03G 9/0819; G03G 9/08711; G03G 9/0821; G03G 9/08797; G03G 15/0818; G03G 9/08; G03G 9/0802; G03G 9/08795; G03G 9/09392; G03G 9/09708; G03G 9/09725; G03G 15/0812

See application file for complete search history.

(56) References Cited

U.S. PATENT DOCUMENTS

| | | | | |
|---|---|---|---|---|
| 5,244,766 | A | 9/1993 | Houle et al. | |
| 5,596,396 | A | 1/1997 | Landa et al. | |
| 6,218,066 | B1 | 4/2001 | Zhao et al. | |
| 2006/0153596 | A1 * | 7/2006 | Gilan et al. | 399/237 |
| 2014/0320576 | A1 * | 10/2014 | Bar-Haim et al. | 347/112 |

FOREIGN PATENT DOCUMENTS

WO WO-2011/025508 A1 3/2011

OTHER PUBLICATIONS

International Search Report and Written Opinion dated May 7, 2012 issued on PCT Patent Application No. PCT/EP2012/050883 filed on Jan. 20, 2012, European Patent Office.

* cited by examiner

*Primary Examiner* — Roy Y Yi

(74) *Attorney, Agent, or Firm* — Hewlett-Packard Patent Department

(57) ABSTRACT

Disclosed herein is a method for electrostatic printing, wherein the method comprises (a) providing an ink composition comprising particles comprising a resin, wherein the ink composition contains less than 0.3 mg of charge director per g of solids in the ink composition;

(b) passing the ink composition between a first electrode and a developer roller, wherein sufficient potential is applied between the developer roller and the electrode such that the resin particles are charged and adhere to the developer roller;

(c) transferring at least some of the particles from the developer roller to a photoimaging plate to form an image on the photoimaging plate; and (d) transferring the image from the photoimaging plate to a print medium.

Also disclosed here is an apparatus for carrying out the method, and a print medium printed using the method.

13 Claims, 2 Drawing Sheets

ELECTROSTATIC PRINTING

CLAIM FOR PRIORITY

The present application is a national stage filing under 35 U.S.C 371 of PCT application number PCT/EP2012/050883, having an international filing date of Jan. 20, 2012, the disclosure of which is hereby incorporated by reference in its entirety.

BACKGROUND

In general, electrostatic printing processes involve creating an image on a photoconductive surface, applying an ink having charged particles to the photoconductive surface, such that they selectively bind to the image, and then transferring the charged particles in the form of the image to a print medium.

The photoconductive surface is typically on a cylinder and is often termed a photo imaging plate (PIP). The photoconductive surface is selectively charged with a latent electrostatic image having image and background areas with different potentials. For example, an electrostatic ink composition comprising charged toner particles, which may be suspended in a liquid carrier, can be brought into contact with the selectively charged photoconductive surface. The charged toner particles adhere to the image areas of the latent image while the background areas remain clean. The image is then transferred to a print medium (e.g. paper) directly or, more commonly, by being first transferred to an intermediate transfer member, which can be a soft swelling blanket, and then to the print medium. Variations of this method utilize different ways for forming the electrostatic latent image on a photoreceptor or on a dielectric material.

DETAILED DESCRIPTION

Figure 1:
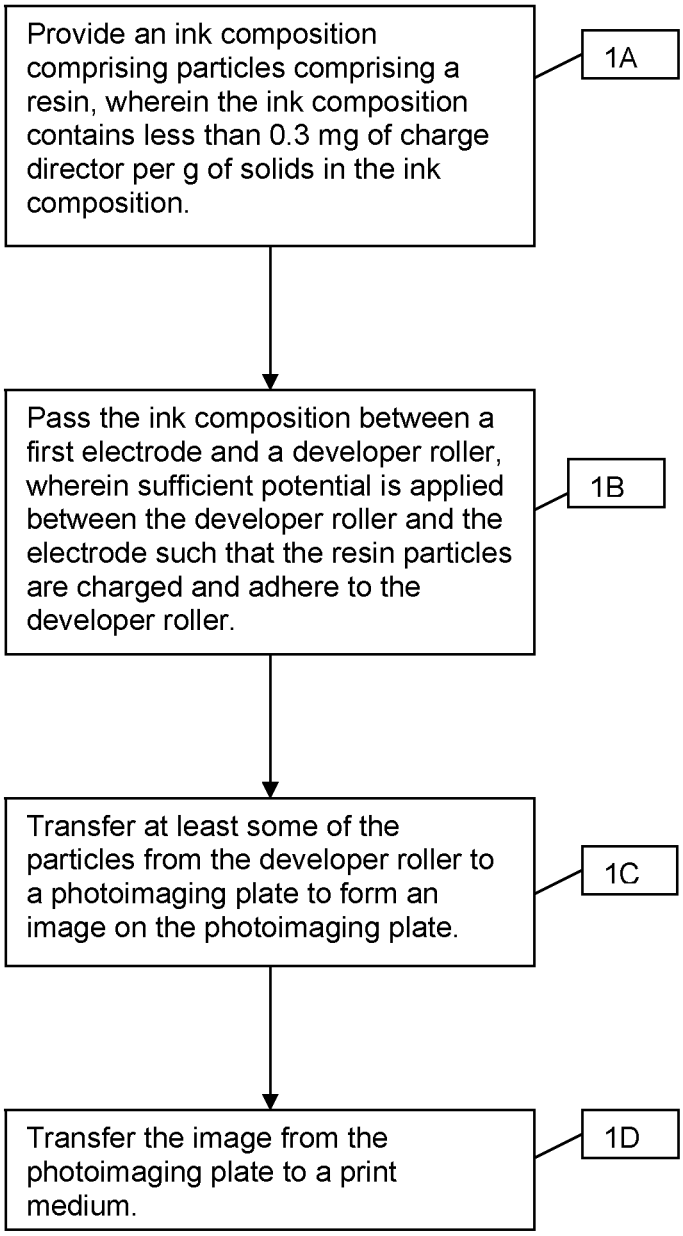
FIG. 1 shows a schematic illustration of a method described herein.

Before the present invention is disclosed and described, it is to be understood that this invention is not limited to the particular process steps and materials disclosed herein because such process steps and materials may vary somewhat. It is also to be understood that the terminology used herein is used for the purpose of describing particular examples only. The terms are not intended to be limiting because the scope of the present invention is intended to be limited only by the appended claims and equivalents thereof.

It is noted that, as used in this specification and the appended claims, the singular forms "a," "an," and "the" include plural referents unless the context clearly dictates otherwise.

As used herein, "liquid carrier", "carrier liquid," "carrier," or "carrier vehicle" refers to the fluid in which the polymers, particles, colorant, charge directors and other additives can be dispersed to form a liquid electrostatic ink or electrophotographic ink. Such carrier liquids and vehicle components are known in the art. Typical carrier liquids can include a mixture of a variety of different agents, such as surfactants, co-solvents, viscosity modifiers, and/or other possible ingredients.

As used herein, "electrostatic ink composition" generally refers to an ink composition that is typically suitable for use in an electrostatic printing process, sometimes termed an electrophotographic printing process.

As used herein, "pigment" generally includes pigment colorants, magnetic particles, aluminas, silicas, and/or other ceramics or organo-metallics, whether or not such particulates impart color. Thus, though the present description primarily exemplifies the use of pigment colorants, the term "pigment" can be used more generally to describe not only pigment colorants, but other pigments such as organometallics, ferrites, ceramics, etc.

As used herein, "copolymer" refers to a polymer that is polymerized from at least two monomers.

A certain monomer may be described herein as constituting a certain weight percentage of a polymer. This indicates that the repeating units formed from the said monomer in the polymer constitute said weight percentage of the polymer.

If a standard test is mentioned herein, unless otherwise stated, the version of the test to be referred to is the most recent at the time of filing this patent application.

As used herein, "electrostatic printing" or "electrophotographic printing" generally refers to the process that provides an image that is transferred from a photo imaging substrate either directly, or indirectly via an intermediate transfer member, to a print substrate. As such, the image is not substantially absorbed into the photo imaging substrate on which it is applied. Additionally, "electrophotographic printers" or "electrostatic printers" generally refer to those printers capable of performing electrophotographic printing or electrostatic printing, as described above. "Liquid electrophotographic printing" is a specific type of electrophotographic printing where a liquid ink is employed in the electrophotographic process rather than a powder toner. An electrostatic printing process may involve subjecting the electrostatic ink composition to an electric field, e.g. an electric field having a field gradient of 1000 V/cm or more, or in some examples 1500 V/cm or more.

As used herein, the term "about" is used to provide flexibility to a numerical range endpoint by providing that a given value may be "a little above" or "a little below" the endpoint. The degree of flexibility of this term can be dictated by the particular variable and would be within the knowledge of those skilled in the art to determine based on experience and the associated description herein.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 wt % to about 5 wt %" should be interpreted to include not only the explicitly recited values of about 1 wt % to about 5 wt %, but also include individual values and subranges within the indicated range. Thus, included in this numerical range are individual values such as 2, 3.5, and 4 and sub-ranges such as from 1-3, from 2-4, and from 3-5, etc. This same principle applies to ranges reciting only one numerical value. Furthermore, such an interpretation should apply regardless of the breadth of the range or the characteristics being described.

Unless otherwise stated, any feature described herein can be combined with any aspect or any other feature described herein.

In an aspect, there is provided a method for electrostatic printing, wherein the method comprises (a) providing an ink composition comprising particles comprising a resin, wherein the ink composition contains less than 0.3 mg of charge director per g of solids in the ink composition;

(b) passing the ink composition between a first electrode and a developer roller, wherein sufficient potential is applied between the developer roller and the electrode such that the resin particles are charged and adhere to the developer roller;

(c) transferring at least some of the particles from the developer roller to a photoimaging plate to form an image on the photoimaging plate; and (d) transferring the image from the photoimaging plate to a print medium.

In an aspect, there is provided an apparatus for electrostatic printing, wherein the apparatus comprises a first electrode, a developer roller, and a photoimaging plate, wherein the first electrode and the developer roller are, in use, spaced apart to define a gap through which an ink composition comprising particles comprising a resin can pass, and wherein the photoimaging plate is disposed adjacent the developer roller, to allow transfer of particles from the developer roller to the photoimaging plate;

wherein the apparatus is configured to apply sufficient potential between the first electrode and the developer roller to charge the particles comprising a resin in the ink composition when the ink composition contains less than 0.3 mg of charge director per g of solids in the ink composition.

In an aspect, there is provided a print medium having printed thereon an ink composition comprising a resin comprising a first polymer that is a copolymer of ethylene or propylene and an ethylenically unsaturated acid of either acrylic acid and methacrylic acid, and wherein the electrostatic ink composition substantially lacks a charge director.

The present inventors have found that they can print an ink composition containing a low amount or no charge director in an electrostatic printing process. This is surprising, since it was expected that a charge director should be present to impart charge on the resin-containing particles, to allow them to be manipulated in an electric field gradient. This is advantageous, since compositions containing a significant amount of charge director have been found to deteriorate over an extended period. By developing a system that avoids the need to use a charge director, while still printing high quality images, this allows for compositions to be created that have a very long shelf-life. Additionally, the present inventors have found that they can effectively charge the toner particles to negative or positive polarity by alteration of the relative polarities of the electrodes; thus allowing for more versatility in the charging of the particles.

Ink Composition

The ink composition in step (a) comprises particles comprising a resin. In some examples, the ink composition further comprises a liquid carrier, and the particles comprising a resin may be suspended in the liquid carrier. The ink composition may further comprise a colorant. The particles comprising the resin may further comprise a colorant. In some examples, the ink composition may substantially lack or lack a liquid carrier, and the particles may be in flowable form, for example so that they can be passed through the apparatus described herein. In some examples, the ink composition may be in powder form.

The resin may include a thermoplastic polymer. In particular, the polymer of the resin may be selected from ethylene acrylic acid copolymers; methacrylic acid copolymers; ethylene vinyl acetate copolymers; copolymers of ethylene (e.g. 80 wt % to 99.9 wt %) and alkyl (e.g. C1 to C5) ester of methacrylic or acrylic acid (e.g. 0.1 wt % to 20 wt %); copolymers of ethylene (e.g. 80 wt % to 99.9 wt %), acrylic or methacrylic acid (e.g. 0.1 wt % to 20.0 wt %) and alkyl (e.g. C1 to C5) ester of methacrylic or acrylic acid (e.g. 0.1 wt % to 20 wt %); polyethylene; polystyrene; isotactic polypropylene (crystalline); ethylene ethyl acrylate; polyesters; polyvinyl toluene; polyamides; styrene/butadiene copolymers; epoxy resins; acrylic resins (e.g. copolymer of acrylic or methacrylic acid and at least one alkyl ester of acrylic or methacrylic acid wherein alkyl may include from 1 to about 20 carbon atoms, such as methyl methacrylate (e.g. 50 wt % to 90 wt %)/methacrylic acid (e.g. 0 wt % to 20 wt %)/ethylhexylacrylate (e.g. 10 wt % to 50 wt %)); ethylene-acrylate terpolymers: ethylene-acrylic esters-maleic anhydride (MAH) or glycidyl methacrylate (GMA) terpolymers; ethylene-acrylic acid ionomers and combinations thereof.

In some examples, the resin comprises a first polymer that is a copolymer of ethylene or propylene and an ethylenically unsaturated acid of either acrylic acid and methacrylic acid. In some examples, the first polymer is absent ester groups and the resin further comprises a second polymer having ester side groups that is a co-polymer of (i) a first monomer having ester side groups selected from esterified acrylic acid or esterified methacrylic acid, (ii) a second monomer having acidic side groups selected from acrylic or methacrylic acid and (iii) a third monomer selected from ethylene and propylene.

In step (a), the resin may constitute 5% to 99% by weight of the solids in the ink composition, in some examples 50% to 90% by weight of the solids of the ink composition, in some examples 70% to 90% by weight of the solids of the ink composition. The remaining wt % of the solids in the ink composition may be the colorant and, in some examples, any other additives that may be present.

As mentioned herein, the ink composition may further comprise a liquid carrier, and the particles comprising a resin may be suspended in the liquid carrier. Generally, the liquid carrier acts as a dispersing medium for the other components in the ink. For example, the liquid carrier can comprise or be a hydrocarbon, silicone oil, vegetable oil, etc. The liquid carrier can include, but is not limited to, an insulating, non-polar, non-aqueous liquid that is used as the medium for toner particles. The liquid carrier can include compounds that have a resistivity in excess of about $10^9$ ohm-cm. The liquid carrier may have a dielectric constant below about 30, in some examples below about 10, in some examples below about 5, in some examples below about 3. The liquid carrier can include, but is not limited to, hydrocarbons. The hydrocarbon can include, but is not limited to, an aliphatic hydrocarbon, an isomerized aliphatic hydrocarbon, branched chain aliphatic hydrocarbons, aromatic hydrocarbons, and combinations thereof. Examples of the liquid carriers include, but are not limited to, aliphatic hydrocarbons, isoparaffinic compounds, paraffinic compounds, dearomatized hydrocarbon compounds, and the like. In particular, the liquid carriers can include, but are not limited to, Isopar-G™, Isopar-H™, Isopar-L™, Isopar-M™, Isopar-K™, Isopar-V™, Norpar 12™, Norpar 13™, Norpar 15™, Exxol D40™, Exxol D80™, Exxol D100™, Exxol D130™, and Exxol D140™ (each sold by EXXON CORPORATION); Teclen N-16™, Teclen N-20™, Teclen N-22™, Nisseki Naphthesol L™, Nisseki Naphthesol M™, Nisseki Naphthesol H™, #0 Solvent L™, #0 Solvent M™, #0 Solvent H™, Nisseki Isosol 300™, Nisseki Isosol 400™, AF-4™, AF-5™, AF-6™ and AF-7™ (each sold by NIPPON OIL CORPORATION); IP Solvent 1620™ and IP Solvent 2028™ (each sold by IDEMITSU PETROCHEMICAL CO., LTD.); Amsco OMS™ and Amsco 460™ (each sold by AMERICAN MINERAL SPIRITS CORP.); and Electron, Positron, New II, Purogen HF (100% synthetic terpenes) (sold by ECOLINK™). The liquid carriers and other components of the present disclosure are described in U.S. Pat. Nos. 6,337,168, 6,070,042, and 5,192,638, all of which are incorporated herein by reference.

In some examples, the liquid carrier, in step (a), constitutes about 20 to 99.5% by weight of the ink composition, in some examples 50 to 99.5% by weight of the ink composition. In some examples, the liquid carrier, in step (a), constitutes about 40 to 90% by weight of the ink composition. In some examples, in step (a), the liquid carrier constitutes about 60 to 80% by weight of the ink composition. In some examples, in step (a), the liquid carrier may constitute about 90 to 99.5% of the electrostatic ink composition, in some examples 95 to 99% of the electrostatic ink composition.

As mentioned herein, in some examples, the ink composition may further comprise a colorant. As mentioned herein, in some examples, the particles comprising the resin may further comprise a colorant. The colorant may be a dye or pigment. The colorant may be any colorant compatible with the liquid carrier and useful for electrostatic printing. For example, the colorant may be present as pigment particles, or may comprise a resin (in addition to the polymers described herein) and a pigment. The resins and pigments can be any of those commonly used as known in the art. In some examples, the colorant is selected from a cyan pigment, a magenta pigment, a yellow pigment and a black pigment. For example, pigments by Hoechst including Permanent Yellow DHG, Permanent Yellow GR, Permanent Yellow G, Permanent Yellow NCG-71, Permanent Yellow GG, Hansa Yellow RA, Hansa Brilliant Yellow 5GX-02, Hansa Yellow X, NOVAPERM® YELLOW HR, NOVAPERM® YELLOW FGL, Hansa Brilliant Yellow 10GX, Permanent Yellow G3R-01, HOSTAPERM® YELLOW H4G, HOSTAPERM® YELLOW H3G, HOSTAPERM® ORANGE GR, HOSTAPERM® SCARLET GO, Permanent Rubine F6B; pigments by Sun Chemical including L74-1357 Yellow, L75-1331 Yellow, L75-2337 Yellow; pigments by Heubach including DALAMAR® YELLOW YT-858-D; pigments by Ciba-Geigy including CROMOPHTHAL® YELLOW 3 G, CROMOPHTHAL® YELLOW GR, CROMOPHTHAL® YELLOW 8 G, IRGAZINE® YELLOW 5GT, IRGALITE® RUBINE 4BL, MONASTRAL® MAGENTA, MONASTRAL® SCARLET, MONASTRAL® VIOLET, MONASTRAL® RED, MONASTRAL® VIOLET; pigments by BASF including LUMOGEN® LIGHT YELLOW, PALIOGEN® ORANGE, HELIOGEN® BLUE L 690 IF, HELIOGEN® BLUE TBD 7010, HELIOGEN® BLUE K 7090, HELIOGEN® BLUE L 710 IF, HELIOGEN® BLUE L 6470, HELIOGEN® GREEN K 8683, HELIOGEN® GREEN L 9140; pigments by Mobay including QUINDO® MAGENTA, INDOFAST® BRILLIANT SCARLET, QUINDO® RED 6700, QUINDO® RED 6713, INDOFAST® VIOLET; pigments by Cabot including Maroon B STERLING® NS BLACK, STERLING® NSX 76, MOGUL® L; pigments by DuPont including TIPURE® R-101; and pigments by Paul Uhlich including UHLICH® BK 8200.

The amounts of charge director described herein may relate to the total amount of charge director in the ink composition. In some examples, a plurality of types of charge director may be included in the ink composition and the amounts are the sum of the different types of charge director in the ink composition.

As mentioned above, in some electrostatic inks of the prior art a charge director has been added to the carrier liquid in order to impart electrostatic charge on the ink particles. Below a level of 0.3 mg of charge director per g of solids of the ink composition, little, if any, charging effect is usually seen. In step (a) of the method, the ink composition may contain less than 0.2 mg of charge director per g of solids in the ink composition, in some examples less than 0.1 mg of charge director per g of solids in the ink composition, in some examples less than 0.05 mg charge director per g of solids in the ink composition. In some examples, in step (a) of the method, the ink composition is substantially free or free of charge director. In some examples, in step (a) of the method, the charge director is defined as a director selected from zirconium salts of fatty acids, e.g. zirconium octoate, metal salts of sulfo-succinates, metal salts of oxyphosphates, metal salts of alkyl-benzenesulfonic acid, metal salts of aromatic carboxylic acids or sulfonic acids, polyoxyethylated alkylamines, lecithin, polyvinylpyrrolidone and organic acid esters of polyvalent alcohols. In some examples, in step (a) of the method, the ink composition is substantially free or free of zirconium salts of fatty acids, e.g. zirconium octoate, metal salts of sulfo-succinates, metal salts of oxyphosphates, metal salts of alkyl-benzenesulfonic acid, metal salts of aromatic carboxylic acids or sulfonic acids, polyoxyethylated alkylamines, lecithin, polyvinylpyrrolidone and organic acid esters of polyvalent alcohols. In some examples, in step (a) of the method, the ink composition is substantially free or free of oil-soluble petroleum sulfonates (e.g. neutral Calcium Petronate™, neutral Barium Petronate™, and basic Barium Petronate™), polybutylene succinimides (e.g. OLOA™ 1200 and Amoco 575), and glyceride salts (e.g. sodium salts of phosphated mono- and diglycerides with unsaturated and saturated acid substituents), sulfonic acid salts including, but not limited to, barium, sodium, calcium, and aluminum salts of sulfonic acid. In some examples, in step (a) of the method, the ink composition is substantially free or free of sulfonic acids, including, but not limited to, alkyl sulfonic acids, aryl sulfonic acids, and sulfonic acids of alkyl succinates (e.g. see WO 2007/130069).

In some examples, a charge director is a substance, which, when added to an ink composition absent this substance, in an amount of 5 mg of the substance per g of solids of the ink composition, increases the high field conductivity of the ink composition, over a period of 24 hours, by at least 5%, in some examples by at least 10%, in some examples by at least 20%, in some examples by at least 30%,. in some examples by at least 50%, in some examples by at least 100%. The high field conductivity, in this context, is measured at 1500 V/mm using a DC current at 23° C.

The electrostatic ink composition may comprise one or more additives, for example a charge adjuvant, a wax, a surfactant, biocides, organic solvents, viscosity modifiers, materials for pH adjustment, sequestering agents, preservatives, compatibility additives, emulsifiers and the like. In some examples the ink composition, in step (a) of the method, comprises an aluminium salt, such as an aluminium salt of a fatty acid, including, but not limited to aluminium stearate. This acts to stabilise the charge on resin particles after being charged by passing between the first electrode and the developer roller. In some examples, aluminium salts, including aluminium stearate, are not charge directors, for example when used in combination with a resin having acidic side groups.

The method described herein involves passing the ink composition between a first electrode and a developer roller, wherein sufficient potential is applied between the developer roller and the electrode such that the resin particles are charged and adhere to the developer roller.

In some examples, in step (a), the ink has a high field conductivity of 50 pmho/cm or less, in some examples a high field conductivity of 30 pmho/cm or less, in some examples, a high field conductivity of 20 pmho/cm or less, in some examples, a high field conductivity of 10 pmho/cm or less. The high field conductivity of the ink composition is measured at 1500 V/mm using a DC current at 23° C.

In some examples, in step (a), the ink has a low field conductivity of 10 pmho/cm or less, in some examples 5 pmho/cm or less, in some examples 2 pmho/cm or less, in some examples 0 pmho/cm. Low field conductivity is measured by applying a constant amplitude AC voltage to two parallel electrodes and monitoring the current via the fluid—in this instance, the electric field amplitude was 5 V/mm, frequency was 5 Hz, and the temperature was 23° C.

The first electrode can be any suitable electrode capable of applying a potential between the developer roller and the first electrode. The electrode may be stationary relative to the developer roller. The first electrode may have a shape that, at least in part, corresponds to the shape of at least part of the developer roller. For example, if the developer roller is a cylinder having an axis, the electrode may have a cross section that forms part of a circle, the centre of this circle being the same as that for the cylinder. In some examples, if the developer roller is a cylinder having an axis, the electrode may have an inner surface that forms part of a cylinder shape, the axis of this cylinder shape being the same as that for the cylinder of the developer roller. In some examples, the first electrode may form a wall or part of a wall of a reservoir for the ink composition. In some examples, a second electrode may be present that is at substantially the same or the same potential as the first electrode, the second electrode located adjacent the first electrode and the developer roller. In some examples, the first electrode and a second electrode may together form walls or parts of walls of a reservoir for the ink composition.

In examples, there is a gap between the developer roller and the first electrode. In some examples, the gap between the first electrode and the developer roller is at least 100 μm, in some examples at least 200 μm, in some examples at least 300 μm. In some examples, the gap between the first electrode and the developer roller is from 100 μm to 1000 μm, in some examples from 100 μm to 800 μm, in some examples from 100 μm to 700 μm, in some examples from 200 μm to 600 μm, in some examples from 200 μm to 600 μm, in some examples from 300 μm to 500 μm, in some examples from 350 μm to 450 μm.

In some examples, the first electrode may be in the form of roller or a belt, having a surface that can move in the same direction as the surface of the developer roller, and may contact the surface of the developer roller. If the first electrode is in the form of a roller, e.g. a cylinder, the roller of the first electrode may have a diameter that is less than the diameter of developer roller.

The first electrode may comprise any electrically conducting material, including, but not limited to, a metal and carbon. The electrode may comprise a metal selected from copper, aluminium, and steel.

In the method, sufficient potential is applied between the developer roller and the electrode such that the resin particles are charged and adhere to the developer roller. The potential difference between the developer roller and the electrode may be 1200 V or more, in some examples 1300 V or more, in some examples 1350 V or more, in some examples 1400 V or more, in some examples 1500 V or more, in some examples 1800 V or more, in some examples 2000 V or more, in some examples 2400 V or more.

In some examples, the potential applied to the electrode is −1800 V or less (i.e. more negative), in some examples −2000 V or less, in some examples −2200 V or less, in some examples −2200 V or less, in some examples −2500 V or less, and the developer roller is at a potential more positive than the electrode. The developer roller may, for example, be at a potential of −600 V or more, in some examples −550 V or more, in some examples −500 V or more, in some examples −450 V or more, in some examples −400 V or more.

In some examples, the potential applied to the electrode is 1800 V or more (i.e. more positive), in some examples 2000 V or more, in some examples 2200 V or more, in some examples 2200 V or more, in some examples 2500 V or more, and the developer roller is at a potential less positive than the electrode. The developer roller may, for example, be at a potential of 600 V or less, in some examples 550 V or less, in some examples 500 V or less, in some examples 450 V or less, in some examples 400 V or less.

The apparatus described herein may be configured to carry out the method herein. The apparatus described herein may be configured to apply the potentials described herein. The apparatus may be programmed to carry out the method described herein and/or apply the potentials applied herein. The apparatus may be controlled by computer software and hardware containing instructions to carry out the method described herein and/or apply the potentials described herein.

In the method, the surface of the developer roller may travel at a speed of from 0.1 to 5 m/sec, in some examples 0.5 to 4 m/sec, in some examples 1 to 3 m/sec, in some examples 1.5 to 2.5 m/sec, in some examples about 3 m/sec.

The gradient of the potential in the gap between the developer roller and the first electrode may be at least about $1\times10^5$ V/m, in some examples at least about $5\times10^5$ V/m, in some examples at least about $1\times10^6$ V/m, in some examples at least about $2\times10^6$ V/m, in some examples at least about $3\times10^6$ V/m, in some examples at least about $4\times10^6$ V/m, in some examples at least about $5\times10^6$ V/m, in some examples at least about $5.5\times10^6$ V/m, in some examples at least about $6\times10^6$ V/m. The gradient of the potential in the gap between the developer roller and the first electrode may be from about $1\times10^5$ V/m to about $1\times10^8$ V/m, in some examples from about $1\times10^5$ V/m to about $1\times10^7$ V/m, in some examples from about $1\times10^6$ Vim to about $1\times10^7$ V/m, in some examples from about $2\times10^6$ V/m to about $8\times10^6$ V/m, in some examples from about $2\times10^6$ V/m to about $7\times10^6$ V/m, in some examples from about $2\times10^6$ V/m to about $7\times10^6$ V/m, in some examples from about $3\times10^6$ V/m to about $6\times10^6$ V/m. The gradient potential may be calculated by determining the difference in potential between the developer roller and the first electrode, and dividing this difference in potential by the distance of the gap between the developer roller and the first electrode at their closest point.

The first electrode may be positioned below the developer roller, with a separation between the first electrode and developer roller forming a gap. The method may be such that the ink for the electrostatic printing process fills, or at least partially, the gap between the developer roller and the first electrode, and the potential in step (b) is applied such that the particles comprising the resin become adhered to the developer roller.

In some examples, the first electrode comprises a roller, which is positioned below the developer roller, and in a reservoir for the ink composition to be concentrated (in step (a)).

Developer Roller

The developer roller may comprise a metal. In some examples, the developer roller may comprise a metal having a surface covering comprising an elastomeric material. For example, the developer roller may comprise a metal core with an outer surface layer comprising an elastomeric material. The metal may be selected from, but is not limited to, steel, aluminium and copper. The surface covering or outer surface layer may comprise an elastomeric material and a resistivity control agent, which may be dispersed in the elastomeric material. The resistivity control agent may act to increase or decrease the resistivity of the elastomeric material (compared to the same material absent said resistivity control agent). The elastomeric material may comprise a material selected from chloroprene rubber, isoprene rubber, EPDM rubber, polyurethane rubber, epoxy rubber, butyl rubber, fluoroelastomers (such as the commercially available Viton) and polyurethane.

The resistivity control agent, which may be dispersed in the elastomeric material, may be selected from an ionic material, a metal, or carbon. The ionic material may be a quaternary ammonium compound. The resistivity control agent, which may be dispersed in the elastomeric material, may be selected from organic dyes, organic pigments, organic salts, polyelectrolytes, inorganic salts, plasticisers, inorganic pigments, metallic particles, charge transfer complexes or materials which produce charge transfer complexes with the elastomeric material, e.g. polyurethane. The resistivity control agent may be present in an amount of 0.1 to 6 wt % of the surface covering, with, in some examples, the remaining wt percentage being the elastomeric material. The resistivity control agent may be or may comprise a quaternary ammonium compound, for example a compound of the formula (NR1'R2'R3'R4)X', in which $R^{1'}$ $R^{2'}$ $R^{3'}$ and $R^4$ are each independently hydrocarbon groups, including, but not limited to, alkyl or aryl groups, and wherein the alkyl is substituted or unsubstituted, branched or straight-chain, saturated or unsaturated, and X' is an anion, such as a halide. Examples of quaternary ammonium compounds include, but are not limited to, tetraheptyl ammonium bromide, trimethyloctadecylammonium chloride, benzyltrimethylammonium chloride. In some examples, the resistivity control agent is a lithium salt.

If the developer roller comprises a metal core with an outer surface layer comprising an elastomeric material, the resistivity of the surface of the developer roller may be from $1\times10^5$ Ohm*m to $1\times10^8$ Ohm*m, in some examples $1\times10^6$ Ohm*m to $1\times10^7$ Ohm*m, when measured between the roller and a metal rod in contact, the total area of the contact along the roller of about 340 mm is about 1 cm.

Squeegee Roller

In one example, the method involves using or the apparatus further comprises a squeegee roller. The squeegee roller may be located adjacent the developer roller. In some examples, the surfaces of the squeegee roller and the developer roller, in the absence of an ink composition, are in contact. In some examples, one or both of the squeegee roller and the developer roller has a compressible surface. In use, the squeegee roller may be adapted to rotate in an opposite direction from the developer roller.

The squeegee roller may comprise a metal. In some examples, the squeegee roller may comprise a metal having a surface covering comprising an elastomeric material. For example, the squeegee roller may comprise a metal core, and the metal core may have an outer surface layer comprising an elastomeric material. The metal may be selected from, but is not limited to, steel, aluminium and copper. The surface covering or outer surface layer may comprise an elastomeric material and a resistivity control agent, which may be dispersed in the elastomeric material. The resistivity control agent may act to increase or decrease the resistivity of the elastomeric material (compared to the same material absent said resistivity control agent). The elastomeric material may comprise a material selected from chloroprene rubber, isoprene rubber, EPDM rubber, polyurethane rubber, epoxy rubber, butyl rubber, fluoroelastomers (such as the commercially available Viton) and polyurethane.

The resistivity control agent, which may be dispersed in the elastomeric material, may be selected from an ionic material, a metal or carbon. The ionic material may be a quaternary ammonium compound. The resistivity control agent, which may be dispersed in the elastomeric material, may be selected from organic dyes, organic pigments, organic salts, polyelectrolytes, inorganic salts, plasticisers, inorganic pigments, metallic particles, charge transfer complexes or materials which produce charge transfer complexes with the elastomeric material, e.g. polyurethane. The resistivity control agent may be present in an amount of 0.1 to 6 wt % of the surface covering, with, in some examples, the remaining wt percentage being the elastomeric material. The resistivity control agent may be or may comprise a quaternary ammonium compound, for example a compound of the formula (NR1'R2'R3'R4)X', in which $R^{1'}$ $R^{2'}$ $R^{3'}$ and $R^4$ are each independently hydrocarbon groups, including, but not limited to, alkyl or aryl groups, and wherein the alkyl is substituted or unsubstituted, branched or straight-chain, saturated or unsaturated, and X' is an anion, such as a halide. Examples of quaternary ammonium compounds include, but are not limited to, tetraheptyl ammonium bromide, trimethyloctadecylammonium chloride, benzyltrimethylammonium chloride. In some examples, the resistivity control agent is a lithium salt.

In one example, the potential difference between the squeegee roller and the developer roller is at least 200 V, in some examples at least 250 V, in some examples at least 300 V, in some examples at least 350 V, in some examples at least 380 V, in some examples at least 400 V. In some examples, the potential applied to the squeegee roller is −600 V or less, in some examples −650 V or less, in some examples −700 V or less, in some examples −750 V or less, in some examples −780 V or less, in some examples −800 V or less. In some examples, the potential applied to the squeegee roller is −600 V to −950 V, in some examples −550 V to −950 V.

In some examples, the potential applied to the squeegee roller is 600 V or more, in some examples 650 V or more, in some examples 700 V or more, in some examples 750 V or more, in some examples 780 V or more, in some examples 800 V or more. In some examples, the potential applied to the squeegee roller is 600 V to 950 V, in some examples 550 V to 950 V.

In some examples, if the electrode is at a more negative potential than the developer roller, the squeegee roller is also at a more negative potential than the developer roller. In some examples, if the electrode is at a more positive potential than the developer roller, the squeegee roller is also at a more positive potential than the developer roller.

In some examples, the apparatus further comprises a squeegee roller that is engaged with the developer roller, wherein, in use, the squeegee roller rotates in a direction opposite from the developer roller and a potential is applied between the squeegee roller and the developer roller, wherein the potential difference between the squeegee roller and the developer roller is at least 200 V.

In some examples, the ink composition in step (a) further comprises a carrier liquid, in which the particles comprising a resin are suspended, and after step (b) and before step (c), the developer roller rotates, such that the resin particles and the liquid carrier on the developer roller are passed between the nip of a squeegee roller and the developer roller, wherein the squeegee roller is rotating in an opposite direction to the developer roller, and a potential is applied between the developer roller and the squeegee roller, such that the particles are disposed to move toward the developer roller, with some of the liquid carrier present with the particles on the surface of the developer roller being removed, and the potential difference between the squeegee roller and the developer roller is at least 200 V. The nip of the squeegee roller and the developer roller is the point at which their surfaces are closest to one another.

In some examples, at least some of the particles within the ink composition are circulated past the first electrode a plurality of times before being transferred from the developer roller to the photoimaging plate.

In some examples, at least some of the particles within the ink composition are circulated past the electrode a plurality of times before being transferred from the developer roller to the photoimaging plate while the photoimaging plate and the developer roller are in a disengaged state, then engaging the developer roller with the photoimaging plate, and transferring at least some of the particles from the developer roller to a photoimaging plate. The disengaged state may be a state in which there is a separation between the photoimaging plate and the developer roller. The separation may be such that it prevents the particles transferring from the developer roller to the photoimaging plate. The engaged state may be such that they developer roller and photoimaging plate are sufficiently close such that the particles can contact and transfer from the developer roller to the photoimaging plate. The engaged state may be such that the developer roller and the photoimaging plate would be, in the absence of the particles, in contact.

In some examples, the photoimaging plate is in the form of a cylinder that rotates on an axis and the developer roller rotates on an axis, and the axes of the developer roller and the photoimaging plate are movable relative to one another, such that the developer roller and the photoimaging plate can be moved from a disengaged state to an engaged state. In some examples, the apparatus is configured, in the disengaged state, to circulate an ink composition comprising particles comprising a resin past the electrode and without transfer of particles from the developer roller to the photoimaging plate, and in the engaged state can transfer particles from the developer roller to the photoimaging plate.

In some examples, in the disengaged state, the developer roller and, if present, the squeegee roller, are rotating, and potentials are applied between the developer roller and the first electrode, and, if a squeegee roller is present, the developer roller and the squeegee roller, such that the particles are charged and disposed to move toward the developer roller, but no transfer of particles from the developer roller to the photoimaging plate occurs; in some examples, the potential applied between the developer roller and the first electrode, and, if a squeegee roller is present, the developer roller and the squeegee roller, may be as described herein. In some examples, at least some of the particles on the developer roller, after having passed the squeegee roller in the disengaged state, are removed from the developer roller, and, in some examples, then passed back to the gap between the first electrode and the developer roller and again adhered to the developer roller; in some examples this may be repeated one or more times, before the developer roller is engaged with the photoimaging plate in the engaged state and the particles passed from the developer roller to the photoimaging plate.

In some examples, in the disengaged state, the particles are passed between a first electrode and a developer roller, wherein sufficient potential is applied between the developer roller and the electrode such that at least some of the resin particles are charged and adhere to the developer roller, and the developer roller rotated a full cycle a plurality of times before the developer roller is engaged with the photoimaging plate to form the engaged state in which particles can pass from the developer roller to the photoimaging plate. The plurality of times may be at least 2 times, in some examples at least 5 times, in some examples at least 10 times, in some examples at least 20 times, in some examples at least 40 times, in some examples at least 50 times, in some examples at least 100 times.

In some examples, the apparatus may be in the disengaged state and the particles circulated past the electrode for a period of from 0.1 s to 60 seconds, in some examples, for a period of from 0.5 seconds to 30 seconds, in some examples for a period of from 0.5 seconds to 15 seconds, in some examples for a period of from 0.5 seconds to 10 seconds, before the developer roller is engaged with the photoimaging plate to form the engaged state in which particles can pass from the developer roller to the photoimaging plate.

The method involves transferring at least some of the particles from the developer roller to a photoimaging plate to form an image on the photoimaging plate. In some examples, a potential is applied between the developer roller and the photoimaging plate, such that the particles are disposed to move from the developer roller to the photoimaging plate. In some examples, the photoimaging plate may be at a positive potential relative to the developer roller. In some examples, the photoimaging plate may be at a negative potential relative to the developer roller. In some examples, if the first electrode and, if present, the squeegee roller, is/are at a more positive potential than the developer roller, the photoimaging plate is at a less positive potential than the developer roller. In some examples, if the first electrode and, if present, the squeegee roller, is/are at a more negative potential than the developer roller, the photoimaging plate is at a less negative potential than the developer roller.

Once the image has been formed on the photoimaging plate, the image is transferred to a print medium, in some examples via an intermediate transfer member.

The intermediate transfer member may be a rotating drum, which may have a compressible surface layer, which may be heated, e.g. to a temperature of from 80 to 160° C., in some examples from 90 to 130° C., in some examples from 100 to 110° C.

The print medium may be or comprise any suitable substrate. The print medium may be any suitable substrate capable of having an image printed thereon. The print medium may comprise a material selected from an organic or inorganic material. The material may comprise a natural polymeric material, e.g. cellulose. The material may comprise a synthetic polymeric material, e.g. a polymer formed from alkylene monomers, including, but not limited to, polyethylene and polypropylene, and co-polymers such as styrene-polybutadiene. The polypropylene may be biaxially orientated polypropylene. The material may comprise a metal, which may be in sheet form. The metal may be selected from or made from, for instance, aluminum (Al), silver (Ag), tin (Sn), copper (Cu), mixtures thereof. In some examples, the print medium comprises a cellulosic paper. In some examples, the cellulosic paper is coated with a polymeric material, e.g. a polymer formed from styrene-butadiene resin.

In some examples, the cellulosic paper has an inorganic material bound to its surface (before printing with ink) with a polymeric material, wherein the inorganic material may be selected from, for example, kaolinite or calcium carbonate. The print medium may be a cellulosic print medium such as paper. The cellulosic print medium may be a coated cellulosic print medium, e.g. having a coating of a polymeric material thereon.

In one aspect, there is provided a print medium printed by the method described herein.

In some examples, the apparatus may further comprise a roller for removing ink from a developer roller. Such ink may be removed in a method using the apparatus when the ink has not been transferred to the photoimaging plate. The one or more further rollers may be located at a position between the photoimaging plate and the first electrode. A potential may be applied between the developer roller and the roller for removing ink, such that the particles are disposed to move from the developer roller to the roller for removing ink.

As mentioned above, in an aspect, there is provided, in a print medium having printed thereon an ink composition comprising a resin comprising a first polymer that is a copolymer of ethylene or propylene and an ethylenically unsaturated acid of either acrylic acid and methacrylic acid, and wherein the electrostatic ink composition substantially lacks a charge director. In some examples, the first polymer is absent ester groups and the resin further comprises a second polymer having ester side groups that is a co-polymer of (i) a first monomer having ester side groups selected from esterified acrylic acid or esterified methacrylic acid, (ii) a second monomer having acidic side groups selected from acrylic or methacrylic acid and (iii) a third monomer selected from ethylene and propylene.

In an aspect, there is provided an apparatus for electrostatic printing, wherein the apparatus comprises a first electrode, a developer roller, and a photoimaging plate, wherein the first electrode and the developer roller are, in use, spaced apart to define a gap, and wherein the photoimaging plate is disposed adjacent the developer roller;

wherein the apparatus is configured to apply a potential difference of at least 1400 V or more between the first electrode and the developer roller. The first electrode, developer roller, and photoimaging plate may be as described herein.

A non-limiting example of the method described herein is shown in FIG. 1. Step 1A is to provide an ink composition comprising particles comprising a resin, wherein the ink composition contains less than 0.3 mg of charge director per g of solids in the ink composition. Step 1B is to pass the ink composition between a first electrode and a developer roller, wherein sufficient potential is applied between the developer roller and the electrode such that the resin particles are charged and adhere to the developer roller. Step 1C is to transfer at least some of the particles from the developer roller to a photoimaging plate to form an image on the photoimaging plate. Step 1D is to transfer the image from the photoimaging plate to a print medium.

A non-limiting example of the apparatus and method as described herein will now be described with reference to FIG. 2.

Figure 2:
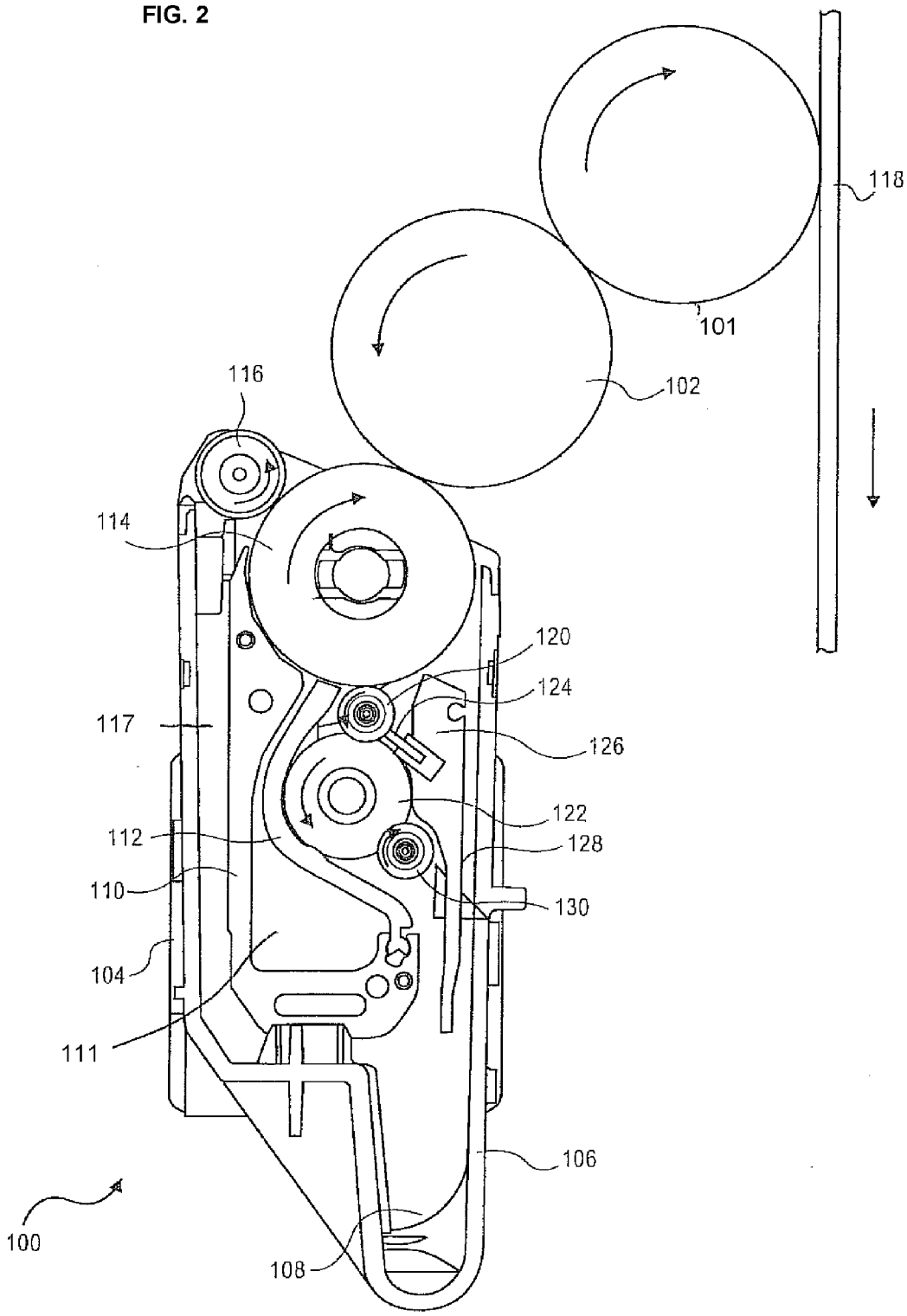
FIG. 2 shows a schematic illustration of an example of an apparatus as described herein for electrostatic printing, upon which examples of the method described herein can be carried out.

FIG. 2 shows an apparatus for electrostatic printing 100. The apparatus includes a blanket drum, 101, a photoimaging plate in the form of a photoconductive drum 102, and a binary ink developer (BID) part of the apparatus 104.

The binary ink developer 104 includes a housing 106 within which the other components of the BID are disposed. The housing 106 defines an ink tray 108 that stores ink that is ultimately used to form an image on a media sheet 118. In some examples, the ink is ink composition comprising particles comprising a liquid carrier, with particles comprising a resin dispersed therein.

The BID 104 includes a first electrode 110 and a second electrode 112. Both the first electrode 110 and second electrode 110 may be at a negative electrical potential, such as −1800 volts or less. The first and second electrodes define an inlet chamber 111. The first electrode has a surface that corresponds substantially in shape to the curved outer surface of the developer roller 114. In use, the ink composition comprising particles comprising a resin is transferred to the inlet chamber 111, filling it until the surface of the liquid ink composition reaches the top of the chamber 111, and contacts the rotating developer roller 114. The present inventors have found that if sufficient potential is applied between the first electrode 110 and the developer roller, surprisingly, the resin-containing particles become sufficiently charged, in the absence of a charge director. The charging of the resin particles is promoted if there is circulation of the ink around the BID before it is transferred to the photoimaging plate 102. This circulation will be described in more detail later.

The developer roller 114 is at an electrical potential that is less negative than the electrode 110, for example in the range of −200 to −600 volts. The developer roller 114 rotates as indicated in FIG. 2. As the liquid ink composition contacts the developer roller, the particles migrate in the electric field toward and adhere to the developer roller. Some of the liquid carrier remains with the particles on the developer roller.

The BID 104 includes a squeegee roller 116, which rotates in the opposite direction as compared to the developer roller 114, and which is at an electrical potential that is more negative than the developer roller 114, such as a potential in the range of −600 to −1000 volts. As the developer roller 114 rotates, the ink composition on the developer roller is brought into contact with the squeegee roller. The squeegee roller, in the absence of ink, presses against the developer roller, and either one or both of the squeegee roller or developer roller has a compressible surface. When the ink passes between the developer roller and the squeegee roller, the resin-containing particles are again disposed to move toward the developer roller, due to the potential difference between the developer roller and squeegee roller, and some of the liquid carrier associated with the particles is removed, concentrating the ink on the developer roller. The liquid carrier that is removed flows down into cavity 117, and then into the ink tray ink tray 108, which is fluidly connected with cavity 117.

The apparatus further provides a photoconductive drum 102, which is rotating in the opposite direction in relation to the developer roller 114 as indicated in FIG. 2. After the ink has been concentrated on the developer roller by the squeegee roller, it moves around the developer roller as it rotates until it reaches the photoconductive drum 102. The ink remaining on the developer roller 114 is selectively transferred to the photoconductive drum 102, which is rotating in the opposite direction in relation to the developer roller 114 as indicated in FIG. 2. The photoconductive drum 102 has previously been selectively charged in correspondence with the image desired to be formed on a media sheet 118. The ink on the developer roller 114 is transferred to the photoconductive drum 102 just where the drum 102 has been selectively charged. Thereafter, the photoconductive drum 102 makes contact with a blanket drum 101, which makes contact with the media sheet 118 to transfer the ink onto the media sheet 118. In this way, a desired image is formed on the media sheet 118. The drums 101 and 102 rotate as indicated in FIG. 2.

The ink that is not transferred from the developer roller 114 to the photoconductive drum 102 is referred to as unused ink. The BID 104 includes a cleaner roller 120, which is rotating as indicated in FIG. 2 and is at an electrical potential that is less negative than the developer roller 114, such as −100 to 250 volts. The cleaner roller 120 cleans the unused ink from the developer roller 114.

The BID 104 includes a sponge roller 122, which rotates in the same direction as the cleaner roller 120. The sponge roller 122 is a sponge in that it has a number of open cells, or pores. For instance, the sponge roller 122 may be made from open-cell polyurethane foam. The sponge roller 122 can be compressed, and is compressed by its path being interfered with by the secondary electrode 112, the cleaner roller 120, and a squeezer roller 130 of the BID 104.

The sponge roller 122 absorbs the unused ink cleaned by the cleaner roller 120, and by a wiper blade 124, from the developer roller 114. That is, any unused ink remaining on the cleaner roller 120 that is not absorbed by the sponge roller 122 is scraped from the cleaner roller 120 into the sponge roller 122 by the wiper blade 124. The wiper blade 124 is part of a wiper mechanism 126 of the BID 104, and the wiper mechanism 126 also includes a wiper (back) wall 128.

The squeezer roller 130 wrings out (i.e., releases) the unused ink that has been absorbed by the sponge roller 122 for reuse. Thus, the unused ink released from the sponge roller 122 by the squeezer roller 130 returns to the ink tray 108.

The sponge roller 122 further serves to break up solid parts of the unused ink, allowing it to be mixed homogenously with the less concentrated ink in the ink tray 108. The squeezer roller 130 releases the unused ink from the sponge roller 122 by compressing the sponge roller 122. That is, the squeezer roller 130 squeezes the sponge roller 122 to release the unused ink from the sponge roller 122.

After the sponge roller 122 has been compressed, it subsequently expands, since it is made from resilient material.

As mentioned above, in an example, the ink composition is circulated within the BID 104 before it is transferred to the photoimaging plate 102. In an example, the developer roller 114, if desired with the other components of the BID 104, is movable relative to the photoimaging plate 102, such that the surfaces of the developer roller 114 and the photoimaging plate 102 can be disengaged or separated. In an example, as an initial step in the method, the surfaces of photoimaging plate 102 and the developer roller 114 are disengaged, and the ink is caused to flow around the BID 104, for example circulating on the developer roller 114 past the squeegee roller, to the cleaner roller, where it is removed, each of the rollers having a potential applied to them as they would in a printing process as described above, and the ink then passed back to the in tray, 108, and then transferred back to the developer roller, via inlet chamber 111. After circulation in this disengaged state, the developer roller and the photoimaging plate can be engaged to allow particles to pass from the developer roller to the photoimaging plate.

EXAMPLES

The following examples illustrate a number of variations of the present apparatus and methods that are presently known to the inventors. However, it is to be understood that the following are only illustrative of the application of the principles of the present apparatus and methods. Numerous modifications and alternative apparatus and methods may be devised by those skilled in the art without departing from the spirit and scope of the present apparatus and methods. The appended claims are intended to cover such modifications and arrangements. Thus, while the present apparatus and methods have been described above with particularity, the following examples provide further detail in connection with what are presently deemed to be acceptable.

The present inventors carried out a number of tests with inks to demonstrate that it was possible to print electrostatic ink compositions that lack a charge director, in an electrostatic printing process, and obtain reasonable quality printed images.

In the tests, the inventors used a series II HP-Indigo digital press, which had a BID as shown schematically in FIG. 2, a photoimaging plate 102, a blanket drum 101 and a means for passing the media sheet 118 past the blanket drum 101. They used two different ink formulations, which will be described in detail below, both of which lacked a charge director.

Production of Electrostatic Ink Compositions Lacking a Charge Director

Formulation A—"Coral" Formulation

This Example describes the production of an ink composition/formulation lacking a charge director. This ink formulation uses a formulation with the resins Nucrel 925, Nucrel 2806 and Bynel 2022 in weight proportions 72:18:10 respectively, and is prepared with Isopar L to make paste that then added with pigment, VCA (di/tri Al stearate salt) and HPB. This ink is then diluted to working dispersion solid concentration by adding a heavy oil, such as Isopar and/or Marcol.

The general procedure for producing the ink formulation is described below.

As a first step, the resins Nucrel 925, Nucrel 2806 and Bynel 2022 in weight proportions 72:18:10 respectively were mixed in a Ross double planetary mixer with 1500 grams of Isopar L (an iso-parfinic oil manufactured by EXXON) carrier liquid at a speed of 60 rpm and a temperature of 130° C. for one hour. The total amount of resins in each case was 1000 g. The temperature is then reduced and mixing is continued until the mixture reaches room temperature. During mixing the polymer solvates the Isopar and during the cooling granules of polymer (with solvated carrier liquid) in carrier liquid are produced.

As a second step, 1000 grams of the mixture produced in the first step is charged into a Union Process 1S ball atritor together with 5 grams of aluminum tri-stearate (Riedel de-Haan) as a charge adjuvant and an appropriate amount of pigment. To make a cyan composition, the pigments TB5 and BSG87 were added so that they formed 12.1 and 0.9 wt %, respectively, of the solids of the composition; TB5 indicates a main Cyan pigment, a phthalocyanine pigment blue 15:3 provided by TOYO company. BSG87 indicates a secondary Cyan pigment, a phthalocyanine pigment green 7 provided by BASF company.

For a black ink composition, TB5 and BSG87 were replaced with 15.8 and 3.2 wt % (of the solids in the composition) of the pigment Monarch 800 and Alkali Blue D6200, respectively (available from Cabot AND Flint Group, respectively). For a yellow ink composition, TB5 and BSG87 were replaced with 11.2 and 2.8 wt % (of the solids in the composition) of the pigment Paliotol Yellow D1155 and Paliotol Yellow D1819, respectively (both available from BASF). For a magenta ink composition, TB5 and BSG87 were replaced with 18 and 2.5 wt % (of the solids in the composition) of the pigment Permanent Carmine FBB02 and Quindo Magenta 122, respectively (available from Clariant and Sun Chemical, respectively).

The toner concentrate made above containing resin particles of Nucrel 925, Nucrel 2806 and Bynel 2022 is transferred to the preparation tank and then diluted with additional Isopar L to produce a toner having approximately 5% NVS, with 98% of the carrier liquid being Isopar L.

Wax particles suspended in Isopar-L in a weight percentage of 4.5% with respect to the NVS of the toner particles were added. The wax was a polyethylene wax, Acumist B6, available from Honeywell.

The ink composition produced above lacks a charge director.

Formulation B—"E14.5" Formulation"

This Example describes the production of a further ink formulation, again lacking a charge director. This ink formulation was produced using a lab grinding tool called attritor S1, by mixing the formulation as set out below in Table A:

TABLE A

| Cyan | EI 4.0 (wt %) | Weight attritor (g) | % NVS |
|---|---|---|---|
| Resins | 76.8 | 1503.3 | 25% |
| TB5 | 12.1 | 59.21 | |
| BSG87 | 0.9 | 4.40 | |
| VCA | 2.2 | 10.77 | |
| HPB | 6 | | |
| DS72 | 2 | 9.79 | |
| Sol-L | | 712.5 | |
| % NVS atr. | 20.00% | | |
| Total weight atr. | 2300 | 2300 | |

The 'Resins' used in the above were Nucrel 699, available from DuPont, and A-C 5120, available from Honeywell, in the weight ratio of 4:1.

TB5 indicates a main Cyan pigment, a phthalocyanine pigment blue 15:3 provided by TOYO company. BSG87 indicates a secondary Cyan pigment, a phthalocyanine pigment green 7 provided by BASF company. For a black ink composition, TB5 and BSG87 were replaced with 15.8 and 3.2 wt % (of the solids in the composition) of the pigment Monarch 800 and Alkali Blue D6200, respectively (available from Cabot AND Flint Group, respectively). For a yellow ink composition, TB5 and BSG87 were replaced with 11.2 and 2.8 wt % (of the solids in the composition) of the pigment Paliotol Yellow D1155 and Paliotol Yellow D1819, respectively (both available from BASF). For a magenta ink composition, TB5 and BSG87 were replaced with 18 and 2.5 wt % (of the solids in the composition) of the pigment Permanent Carmine FBB02 and Quindo Magenta 122, respectively (available from Clariant and Sun Chemical, respectively).

VCA indicates an aluminium tristearate and palmitate salt, available from Riedel de-Haan.

HPB indicates an homopolymer polyethylene wax, available under the trade name Acumist B6 from Honeywell company.

DS72 is a silica powder, available under the trade name Aerosil R 7200 from Degussa-Evonik.

Sol-L indicates Isopar L, an iso-parfinic oil manufactured by EXXON.

The HPB was added later to the ink dispersion while mixing.

The grinding was carried out in two steps:

i) Hot stage—53° C. for 1.5 hour.

ii) Cold stage—45° C. for 10.5 hour.

This produced an ink having about 20% solids content. This ink is then diluted to 3% NVS, and then the following additives added, as shown in Table B:

TABLE B

| | W-12 | Marcol | HPB |
|---|---|---|---|
| Cyan 4.5 | 4% W12/ink solids | 0.5 mg M-1/gr Sol-L | 6% on solids |

W12 is a Teflon powder.

Marcol is a high viscous paraffinic oil with a viscosity of 0.83 gr/cc.

HPB indicates an homopolymer polyethylene wax, available under the trade name Acumist B6 from Honeywell company.

The ink composition above lacks a charge director.

Results

The inventors tried various combinations of potentials on the first electrode, developer electrode, squeegee roller and cleaner roller. The results of some of these tests are shown in Table 1 below (all potentials are negative potentials in V).

TABLE 1

| Ink | Color | Electrode (E) potential | Developer (D) potential | Squeegee (S) potential | Cleaner (C) potential | Observed PQ (print quality) |
|---|---|---|---|---|---|---|
| EI4.5 | K | 2400 | 250 | 850 | 200 | Best PQ, low OD, vertical lines, minor rivering |
| EI4.5 | K | 1600 | 250 | 850 | 200 | Stronger vertical lines, more rivering |
| EI4.5 | K | 1600 | 500 | 800 | 250 | Background (in addition to above) |
| EI4.5 | K | 1200 | 300 | 700 | 300 | Poor solids, grainy, dull image |
| Coral | M | 2400 | 400 | 900 | 50 | Best PQ, strong vertical lines, moderate rivering |
| Coral | M | 1900 | 400 | 900 | 20 | Dull image, very strong lines, minor rivering |

TABLE 1-continued

| Ink | Color | Electrode (E) potential | Developer (D) potential | Squeegee (S) potential | Cleaner (C) potential | Observed PQ (print quality) |
|---|---|---|---|---|---|---|
| Coral | M | 1900 | 300 | 800 | 100 | Low OD, grainy image, strong rivering |
| Coral | M | 2400 | 400 | 900 | 500 | Noise at ~2 mm frequency, ghost of image at developer frequency |
| Coral | M | 2000 | 1000 | 1000 | Any | Negative development, strong background |
| Coral | K | 2200 | 500 | 900 | 250 | Best PQ, minor vertical lines |
| Coral | K | 1600 | 500 | 900 | 250 | Moderate rivering, background |
| Coral | K | 1400 | 500 | 900 | 250 | Vertical lines (in addition) |
| Coral | Y | 2200 | 500 | 900 | 250 | Best PQ, minor rivering |
| Coral | Y | 1800 | 500 | 900 | 250 | Moderate rivering, background |

The inventors found the best print results for certain inks (lacking a charge director) were obtained using the potentials as shown in Table 2 (all potentials are negative potentials in V).

TABLE 2

| Ink | Color | Electrode (E) potential | Developer (D) potential | ΔE − D (V) | Squeegee (S) potential | ΔS − D (V) | Cleaner (C) potential |
|---|---|---|---|---|---|---|---|
| EI4.5 | K | 2400 | 250 | 2150 | 850 | 600 | 200 |
| Coral | C | 1900 | 550 | 1350 | 800 | 250 | 250 |
| Coral | M | 2800 | 400 | 2400 | 670 | 270 | 250 |
| Coral | K | 2000 | 500 | 1500 | 900 | 400 | 250 |
| Coral | Y | 2200 | 500 | 1700 | 900 | 400 | 250 |

In tables 1 and 2 above, K indicates black, C indicates cyan, M indicates Magenta, and Y indicates yellow.

By way of comparison, the best print results for certain inks containing a charge director were obtained using the potentials shown in Table 3 (all potentials are negative potentials in V). The inks used here were from the Electroink 4.5 series, available from Hewlett Packard, and each ink contains 15 mg of charge director per g of solids. The charge director was a natural charge director having the components: (i) natural soya lecithin (ii) basic barium petronate and (iii) dodecyl benzene sulphonic acid in the relative weight ratios 6.6:9.8:3.6. The printing apparatus was a HP Indigo 7000 press. The PIP discharge voltage was −50 V.

TABLE 3

| Colour | E | D | S | C |
|---|---|---|---|---|
| Y | 1010 | 460 | 760 | 200 |
| M | 1200 | 450 | 750 | 190 |
| C | 1220 | 470 | 770 | 210 |
| K | 1350 | 500 | 800 | 240 |

While the invention has been described with reference to certain examples, those skilled in the art will appreciate that various modifications, changes, omissions, and substitutions can be made without departing from the spirit of the disclosure. It is intended, therefore, that the invention be limited only by the scope of the following claims. Unless otherwise stated, the features of any dependent claim can be combined with the features of any of the independent claims or other dependent claims.

The invention claimed is:

1. A method for electrostatic printing, wherein the method comprises:

(a) providing an ink composition comprising particles comprising a resin, wherein the ink composition contains less than 0.3 mg of charge director per gram of solids in the ink composition;

(b) passing the ink composition between a first electrode and a developer roller, wherein sufficient potential is applied between the developer roller and the electrode such that the resin particles are charged and adhere to the developer roller;

(c) transferring at least some of the particles from the developer roller to a photoimaging plate to form an image on the photoimaging plate; and (d) transferring the image from the photoimaging plate to a print medium.

2. The method according to claim 1, wherein the ink composition is substantially free of charge director.

3. The method according to claim 1, wherein the potential difference between the developer roller and the first electrode is 1400 V or more.

4. The method according to claim 1, wherein the potential applied to the first electrode is −1800 V or less, and the developer roller is at a more positive potential.

5. The method according to claim 1, wherein, the ink composition in step (a) further comprises a carrier liquid, in which the particles comprising a resin are suspended, and after step (b) and before step (c), the developer roller rotates, such that the resin particles and the liquid carrier on the developer roller are passed between a nip of a squeegee roller and the developer roller, wherein the squeegee roller is rotating in an opposite direction from the developer roller, and a potential is applied between the developer roller and the squeegee roller, such that the particles are disposed to move toward the developer roller, with some of the liquid carrier present with the particles on the surface of the developer roller being removed, and the potential difference between the squeegee roller and the developer roller is at least 200 V.

6. The method according to claim 1, wherein some of the particles within the ink composition are circulated past the first electrode a plurality of times before being transferred from the developer roller to the photoimaging plate.

7. The method according to claim 1, wherein some of the particles within the ink composition are circulated past the electrode a plurality of times before being transferred from the developer roller to the photoimaging plate, and the method further comprising: while the photoimaging plate and the developer roller are in a disengaged state, engaging the developer roller with the photoimaging plate, and transferring at least some of the particles from the developer roller to the photoimaging plate.

8. A method according to claim 1, wherein the resin comprises a first polymer that is a copolymer of ethylene or propylene and an ethylenically unsaturated acid of either acrylic acid and methacrylic acid.

9. A method according to claim 8, wherein the first polymer is absent ester groups and the resin further comprises a second polymer having ester side groups that is a co-polymer of (i) a first monomer having ester side groups selected from esterified acrylic acid or esterified methacrylic acid, (ii) a second monomer having acidic side groups selected from acrylic or methacrylic acid and (iii) a third monomer selected from ethylene and propylene.

10. An apparatus for electrostatic printing, wherein the apparatus comprises:

a first electrode, a developer roller, and a photoimaging plate, wherein the first electrode and the developer roller are, in use, spaced apart to define a gap through which an ink composition comprising particles comprising a resin can pass, wherein the photoimaging plate is disposed adjacent the developer roller, to allow transfer of particles from the developer roller to the photoimaging plate, and wherein the apparatus is to apply sufficient potential between the first electrode and the developer roller to charge the particles comprising a resin in the ink composition when the ink composition contains less than 0.3 mg of charge director per gram of solids in the ink composition.

11. An apparatus according to claim 10, wherein the apparatus is to apply a potential difference of at least 1400 V between the first electrode and the developer roller.

12. An apparatus according to claim 10, wherein the apparatus further comprises a squeegee roller that is engaged with the developer roller, wherein, in use, the squeegee roller rotates in a direction opposite from the developer roller and a potential is applied between the squeegee roller and the developer roller, wherein the potential difference between the developer roller and the squeegee roller is at least 200 V.

13. An apparatus according to claim 10, wherein axes of the developer roller and the photoimaging plate are movable relative to one another, such that the developer roller and the photoimaging plate can be moved from a disengaged state to an engaged state, and wherein the apparatus is, in the disengaged state, to circulate an ink composition comprising particles comprising a resin past the electrode and without transfer of particles from the developer roller to the photoimaging plate, and in the engaged state can transfer particles from the developer roller to the photoimaging plate.

* * * * *